United States Patent [19]

Wich

[11] 4,441,669

[45] Apr. 10, 1984

[54] APPARATUS FOR THE PRODUCTION OF A GUIDE PATTERN OF LIGHT BEAMS

[75] Inventor: Harald Wich, Schwaig, Fed. Rep. of Germany

[73] Assignee: Diehl GmbH & Co., Nuremberg, Fed. Rep. of Germany

[21] Appl. No.: 370,845

[22] Filed: Apr. 22, 1982

[30] Foreign Application Priority Data

May 5, 1981 [DE] Fed. Rep. of Germany ..... 3117685

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,255,984 | 6/1966 | Hawes | 244/3.13 |
| 3,398,918 | 8/1968 | Girault | 244/3.13 |
| 4,149,686 | 4/1979 | Stauff et al. | 244/3.13 |
| 4,174,818 | 11/1979 | Glenn | 244/3.13 |
| 4,195,799 | 4/1980 | Sogo et al. | 244/3.13 |
| 4,245,800 | 1/1981 | Henderson | 244/3.13 |

FOREIGN PATENT DOCUMENTS 1481990 5/1977 Fed. Rep. of Germany .

OTHER PUBLICATIONS

Brochure entitled: "ITT Bauelemente Gruppe Europa", Edition of 4/77-translated as ITT Components, Electro-Optical Ceramics , (4 pages).

Article from "Electronic Design 15", Jul. 19, 1979, (pp. 31-32).

*Primary Examiner*—Charles T. Jordan

*Attorney, Agent, or Firm*—Burns, Doane, Swecker & Mathis

[57] ABSTRACT

An apparatus produces a guide beam pattern for a missile. The guide beam pattern comprises a plurality of bundles of light beams collectively surrounding the axis of the beam pattern. The bundles of beams are modulated differently by different electric modulating potentials from optical modulators. In order to produce the bundles of light beams without mechanical and aligning devices and to obtain a guidance system operating over the entire cross-section of the beam pattern, PLZT ceramic segments are provided as the modulators, each of which forms bundle of light beams. The segments collectively cover the entire cross-section of the beam pattern from a single source of light. A spearate modulating potential is applied to each of the segments.

5 Claims, 7 Drawing Figures

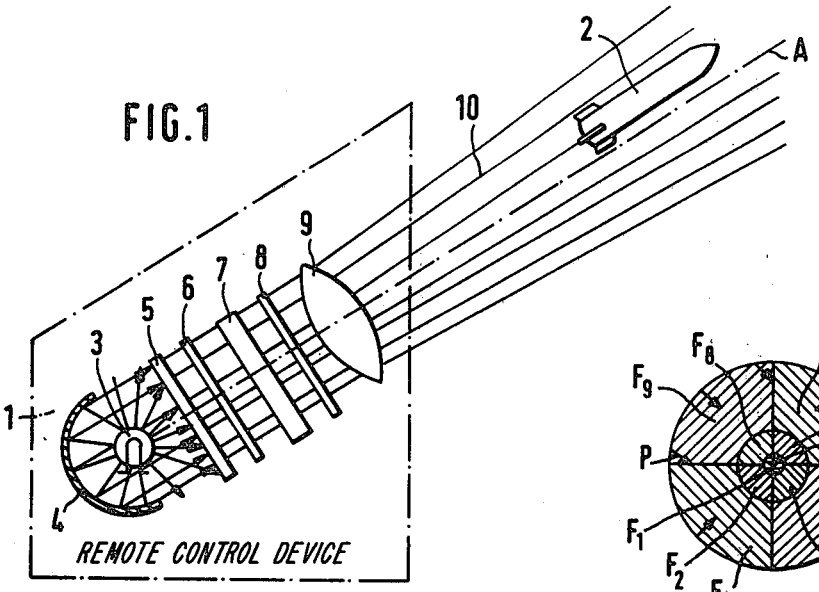
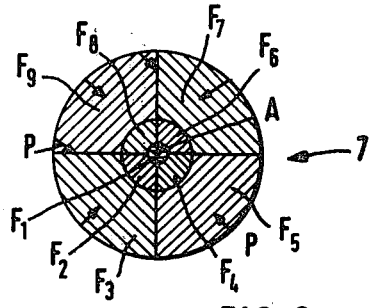
FIG.2
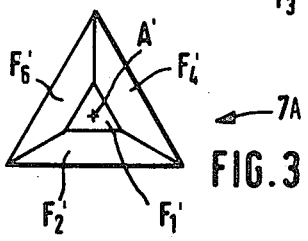
FIG.3
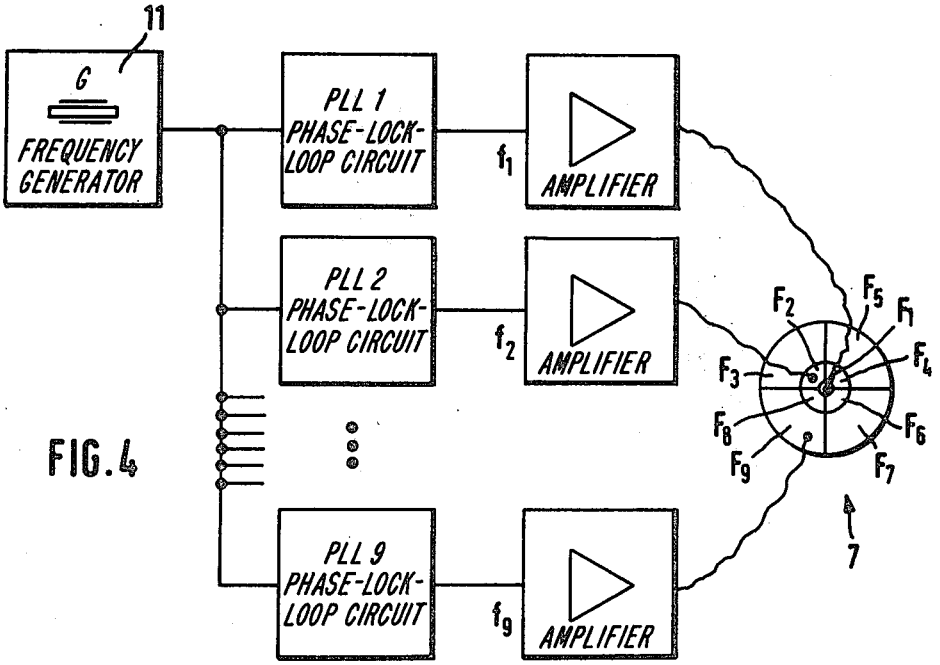
FIG.4

APPARATUS FOR THE PRODUCTION OF A GUIDE PATTERN OF LIGHT BEAMS

BACKGROUND AND OBJECTS OF THE INVENTION

The invention concerns an apparatus for generating a guide beam pattern for a missile, wherein the guide beam pattern comprises a plurality of light beams collectively surrounding the beam pattern axis; the light beams being differentially modulated by optical modulators by means of electrical modulating potentials.

An apparatus of this type is described in DE-AS No. 14 81 990. In this installation, four light beams form a corridor for the missle. Whenever the missle deviates from the center axis, it is detected by one of the beams, from which it derives a control signal resulting in a move toward one of the other beams of light. The missile thus performs a pendulum-like motion between the beams of light. It receives no signal within the corridor, which is a disadvantage from the standpoint of control technology. The beams of light are oriented and adjusted mechanically.

In the case of DE-AS No. 14 81 990, four devices must be employed to generate and shape the beams. Together with the necessary control apparatus for the optical equipment, this results in a substantial construction outlay. A further subdivision of the corridor with the aid of intermediate light beams is therefore not feasible. For this reason, a further device is proposed in DE-AS No. 14 81 990, which differs from the aforementioned type in that it employs two crossed light beams performing a pendulum motion in a pyramid shaped space.

In the German written pamphlet *ITT Components, Electro-Optical Ceramics,* Edition Of 4/77, transparent PLZT ceramics are known, the optical transmission whereof may be controlled by the application of an electrical field. Structural elements of this type are suitable for use as optical modulators. The disclosure of that pamphlet is hereby incorporated by reference herein.

In an article in *Electronic Design* 15, July 19, 1979, page 31, a recorder is described, in which linearly arranged PLZT ceramic fields may be connected individually with a direct current. The disclosure of that article is hereby incorporated by reference herein.

It is an object of the invention to provide an apparatus of the aforementioned type, wherein the optical and mechanical devices are simplified and whereby the guidance of a missle is possible over the entire cross-section of the guide beam pattern.

SUMMARY OF THE INVENTION

These objects are attained according to the invention in an apparatus of the above-described type by providing segments of a PLZT ceramic. Each segment forms a bundle of light beams which segments collectively cover the entire cross-section of the beam pattern from a single source of light while a separate modulating potential is applied to each segment. Optical devices for the individual beams are thus eliminated. A single optical installation may be common to all of the sections and may comprise, for example, an objective zoom lens. Mechanical adjustments of the light beam pattern are not required, as the entire cross-section of the beam pattern is filled by the light. It is further not necessary to align the beams mechanically, since their position is determined by the arrangement of the segments. Each segment and thus each beam bundle is modulated so that the missle, when within the range of radiation of one of the light beam bundles, is guided in the direction of the axis of the beam pattern. For this purpose, there are provided at least three segments adjacent to each other and forming outer bundles of light beams and a segment located along the beam axis and forming an inner bundle of light beams. The modulator located along the beam axis emits a signal to the missle indicating the correct position of the latter and does not trigger a signal deviating from its prevailing position in flight.

THE DRAWINGS

Further advantageous configurations of the invention will become apparent from the description hereinafter of the invention and the dependent claims, wherein:

FIG. 1 shows schematically an apparatus for the production of a guide beam pattern for a missle according to the present invention;

FIG. 2 is a top view of a modulator according to FIG. 1 in the transverse section plane of the beam pattern;

FIG. 3 is a view of a modified, more simplified modulator;

FIG. 4 depicts schematically a circuit layout to actuate the modulator of FIG. 2;

DETAILED DESCRIPTION OF A PREFERRED EMBODIMENT OF THE INVENTION

Figure 6:
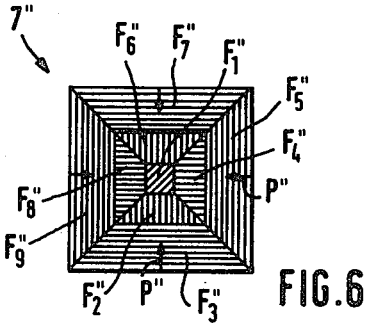
FIG. 6 is a view of a modulator for the apparatus of FIG. 5.

In FIG. 1, a remote control device 1 for a missle 2 is depicted which comprises a continuous beam-emitting source of light 3. The emitted light is passed by way of a concave mirror 4 onto an infrared filter 5. The infrared filter is followed by a polarizer 6. The light leaving the polarizer in the plane of polarization arrives on a PLZT ceramic disk 7, divided into several segments (FIGS. 2, 3 and 6). The disk 7 is followed by an analyzer 8, corresponding in its configuration to the polarizer 6, but with its polarization plane rotated by 90° with respect to the polarizer 6. The analyzer 6 is followed in sequence by a collector lens 9, which advantageously may comprise a zoom objective.

The remote control device 1 emits through the objective lens 9 a guide beam pattern 10 into space, the guide beam pattern comprising bundles of beams serving to determine the course of the missile 2.

FIG. 2 is a view of the PLTZ ceramic disk 7, shown in a cross-section of the guide beam pattern 10, with segments $F_1$ to $F_9$. Each of the segments $F_1$ to $F_9$ represents an optical modulator. The operation of the individual segments $F_1$ to $F_9$ is preferably based on the principle of double refraction, whereby a transverse electric field is applied to the individual segments $F_1$ to $F_9$. The electric field of each segment $F_1$ to $F_9$ is actuated with a different frequency. Each of the bundles of beams passing through the segments $F_1$ to $F_9$ thereby receives a characteristic peculiar to itself.

In the division of the guide beam pattern 10 into bundles of beams according to FIG. 2, altogether nine segments $F_1$ to $F_9$ are used, with two segments (e.g., $F_2$ and $F_3$) being provided in each 90° circular segment. These segments surround a central segment $F_1$ concentrically, with the central segment being located along the beam axis A. In a modified form of a ceramic disk 7A depicted in FIG. 3, only four segments $F'_1$, $F'_2$, $F'_4$, $F'_6$ are provided in a triangular arrangement, with the $F'_1$ segment being located along the beam axis A' and the segments $F'_2$, $F'_4$ and $F'_6$ surrounding it.

The individual segments $F_1$ to $F_9$ according to FIG. 2 are modulated in a double refraction operation by means of different frequencies $f_1$ to $f_9$. According to FIG. 4, a frequency generator 11 is provided for that purpose, the generator producing the different frequencies by means of phase-lock-loop circuits PLL1 to PLL9. A frequency coding of the individual beams passing through the segments F1 to $F_9$ is thereby obtained.

The missile 2 is equipped to evaluate the different frequencies. It generates for the control of flight attitude a correction signal as a function of the beams of light $F_1$ to $F_9$, wherein it is located. In FIG. 2, the directional arrows P are indicating the direction into which the missile 2 is guided when located in one of the bundles of light beams emanating from the segments $F_1$ to $F_9$.

Figure 5:
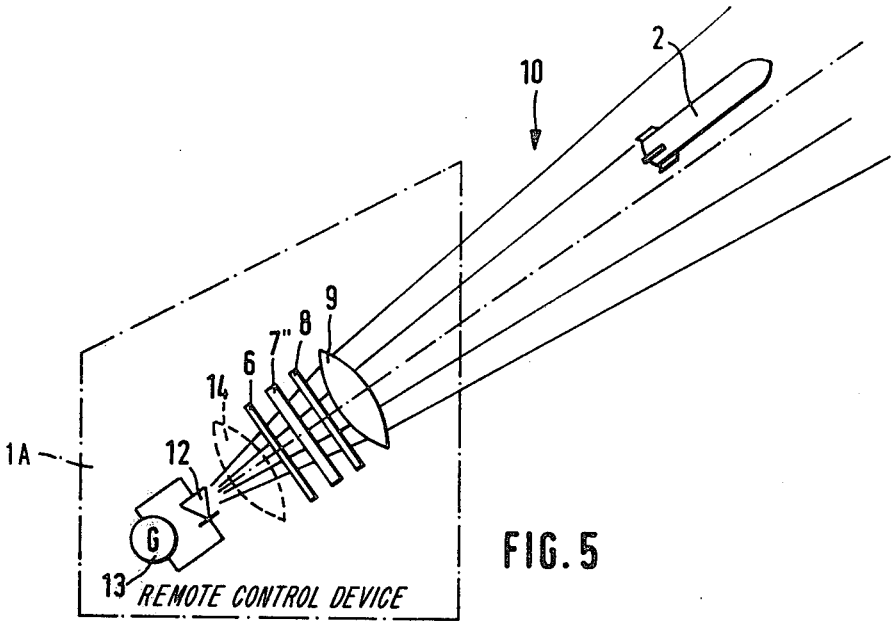
FIG. 5 depicts another apparatus to produce a guide beam pattern for a missle according to the invention.
Figure 7:
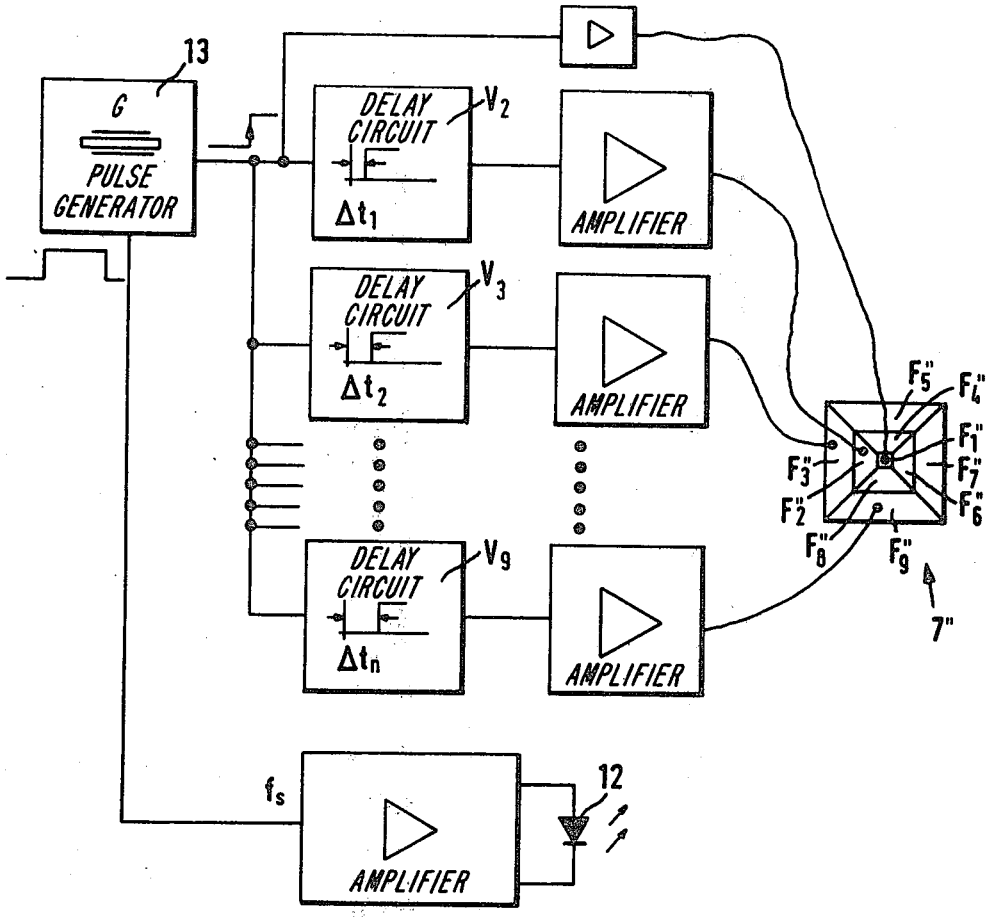
FIG. 7 shows schematically a circuit layout for the actuation of a modulator according to FIG. 6.

A remote control apparatus 1A is shown in FIG. 5, comprising as its source of light a light emitting diode 12, in particular an infrared diode. The source is powered by a pulse generator 13. A rectangular arrangement of the segments $F''_1$ to $F''_9$ (FIG. 6) has been selected here. Pulse length or pulse phase modulation is to be provided for the modulation of the segments $F''_1$ to $F''_9$. FIG. 7 shows a circuit for pulse phase modulation. Each rising side of the generator 13 actuates the diode 12 and the segment $F''_1$. The actuation of the subsequent segments $F''_1$. The actuation of the subsequent segments $F''_2$ to $F''_9$ is individually delayed in steps by means of a delay stage $V_2$ to $V_9$. Accordingly, during each pulse of the generator 13, the individual segments $F''_1$ to $F''_9$ become transparent in succession. The radiation emitted by all of the field terminates with the trailing side of the pulse of the pulse generator 13. Consequently, the longest time lag must be shorter than the duration of the generator pulse.

The evaluation of the delay time of the pulses as a function of the bundle of light beams in which the missle 2 is located, is readily effected within in a simple manner. With this guiding system, it is possible to provide the missle 2 with a strongly selective amplifier circuit, as the pulses have a nearly constant sender frequency which is not readily disturbed by external light.

If a light emitting diode 12 is used, it may be advantageous to employ a collector lens 14 for the intermediate imaging of its light on the polarizer 6.

In place of a light emitting diode 12, a laser or a laser diode may be used. In that case, the polarizer 6 is not needed.

The approximate mode of operation of the aforedescribed remote control apparatus is as follows:

The PLZT disk 7 modulated in its segments $F_1$ to $F_9$ emits bundles of light beams, each of which is modulated in a manner detectable by the missile 2. While the missile 2 is moving in the bundle of the segment $F_1$, no change in its direction will be effected. If it moves into one of the bundles produced by the segments $F_2$, $F_4$, $F_6$ and $F_8$, it performs a slight change in direction as indicated by the arrows P depending on the bundle wherein it is located at the moment. The directional change effected for the missile is the same in each of the bundles of beams. However, the arrangement of the segments insures the fact that in the final analysis the missile is always returned to the longitudinal axis of the beam pattern. It may occur, for example, that the missile, when located far out in the beam bundle of the segment $F_2$, is initially guided into the beam bundle of the segment $F_4$. The latter, however, acts to guide it into the beam bundle of the segment $F_1$ or at least father inside into the beam bundle of the segment $F_2$.

In the case of greater deviations of the missile from the longitudinal axis, when it is located in the bundles of the segments $F_3$, $F_5$, $F_7$, or $F_9$, it derives a guide signal from the modulation therein, which directs it more strongly into the bundle of the segment $F_1$.

As seen particularly in FIG. 2 (and also in FIGS. 3 and 6), the surface areas of the outer segments $F_3$, $F_5$, $F_7$, $F_9$ and $F_2$, $F_4$, $F_6$, respectively, are larger than those of the inner segments $F_2$, $F_4$, $F_6$, $F_8$ and $F_1$, respectively. This results in a finely stepped guiding effect toward the beam axis A.

It is within the scope of the invention to divide without an excessive technical effort the circumference of the guide beam pattern into more than four segments and to provide more than two segments radially, in order to refine the guiding effect.

Although the present invention has been described in connection with a preferred embodiment thereof, it will be appreciated by those skilled in the art, that additions, modifications, substitutions, and deletions not specifically described, may be made without departing from the spirit and scope of the invention as defined in the appended claims.

I claim:

1. Apparatus for producing a guide beam pattern for a missile, wherein the guide beam pattern comprises a plurality of bundles of light beams collectively surrounding an axis of the beam pattern, said bundles of light beams being modulated in individually different manners by means of electric modulating potentials from optical modulators, the improvement wherein said modulators comprise PLZT ceramic segments each of which forming a bundle of light beams, said segments collectively covering the entire cross-section of the beam pattern of a single source of light, and means for applying different modulating potentials to said segments.

2. Apparatus according to claim 1, wherein said segments comprise at least three adjacent segments forming outer bundles of beams and a segment located along the beam axis forming an inner bundle of beams.

3. Apparatus according to claim 1, wherein said segments comprise a plurality of adjacent inner segments surrounded by a plurality of adjacent outer segments, the surface areas of the outer segments being larger than those of the inner segments.

4. Apparatus according to claim 1, wherein said segments are formed by a suitable electrode arrangement on a single PLZT ceramic disk.

5. Apparatus according to claim 1, wherein the PLZT ceramic device is of the type operating in a double refraction mode.

* * * * *